US006182947B1

(12) United States Patent
Meglino

(10) Patent No.: US 6,182,947 B1
(45) Date of Patent: Feb. 6, 2001

(54) FOLDABLE FENCE INSERTS

(76) Inventor: Don A. Meglino, 13 Mott Pl., Glenwood Landing, NY (US) 11547

( * ) Notice: Under 35 U.S.C. 154(b), the term of this patent shall be extended for 0 days.

(21) Appl. No.: 08/966,226

(22) Filed: Nov. 7, 1997

Related U.S. Application Data

(63) Continuation of application No. 08/423,317, filed on Apr. 18, 1995, now abandoned.

(51) Int. Cl.[7] ..... E04H 17/02
(52) U.S. Cl. ..... 256/34; 256/32
(58) Field of Search ..... 256/32, 33, 34, 256/35, 50, 1, 22, 21

(56) References Cited

U.S. PATENT DOCUMENTS

| | | | | |
|---|---|---|---|---|
| 3,355,150 | * | 11/1967 | Taylor | 256/34 |
| 3,572,640 | * | 3/1971 | Vecchiarelli | 256/34 |
| 3,774,884 | * | 11/1973 | Singer | 256/32 |
| 3,958,794 | * | 5/1976 | Suprunuk et al. | 256/34 |
| 4,723,761 | * | 2/1988 | Cluff | 256/34 |
| 4,725,044 | * | 2/1988 | Cluff | 256/34 |
| 4,907,783 | * | 3/1990 | Fisk et al. | 256/32 |
| 5,177,890 | * | 1/1993 | Hisatomi et al. | 256/32 X |
| 5,184,801 | * | 2/1993 | Finkelstein | 256/34 |
| 5,275,380 | * | 1/1994 | Barsby | 256/34 |
| 5,328,156 | * | 7/1994 | Hoke | 256/32 |

FOREIGN PATENT DOCUMENTS

| | | | | |
|---|---|---|---|---|
| 2161307 | * | 6/1973 | (DE) | 256/12.5 |

* cited by examiner

*Primary Examiner*—Harry C. Kim
(74) *Attorney, Agent, or Firm*—Galgano & Burke

(57) ABSTRACT

Privacy inserts for chain link fences comprising at least two portions which are movably connected by a connecting portion so that at least one portion is movable from a first position where it does not overlap another portion to a second position where at least two portions of the fence insert overlap. Also disclosed are methods of inserting these fence inserts into a chain link fence comprising the step of moving at least one portion from a non-overlapping position relative to another portion to a position where the portions overlap prior to inserting the fence insert into a fence.

20 Claims, 4 Drawing Sheets

Fig. 5
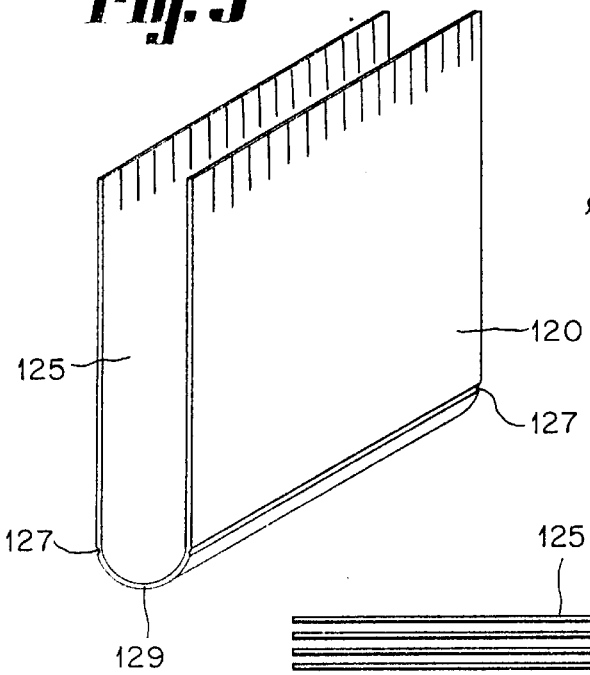
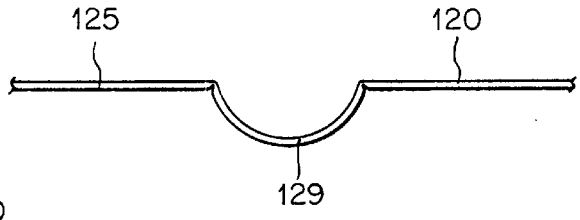
Fig. 5a
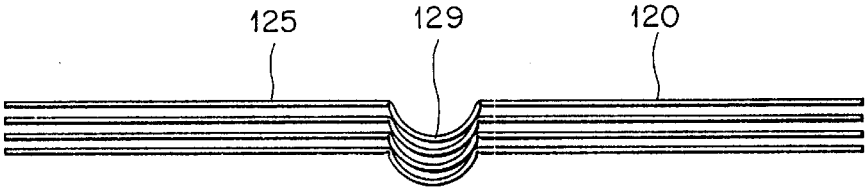
Fig. 6
Fig. 7
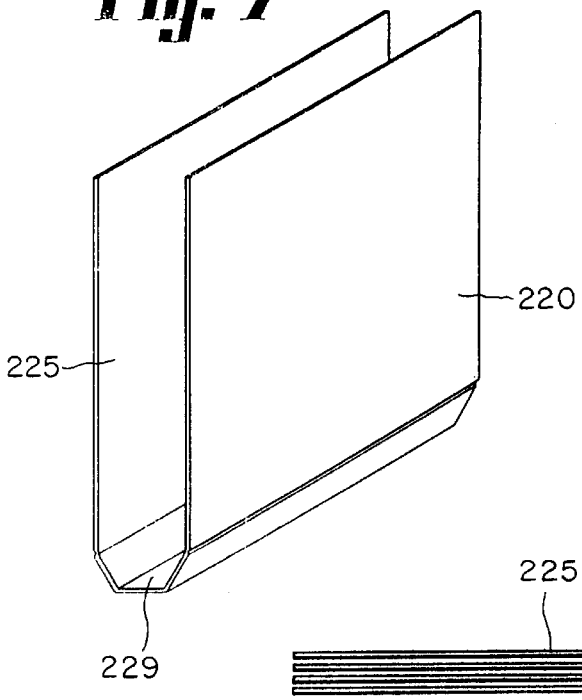
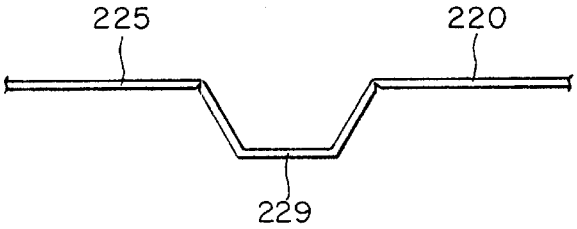
Fig. 7a
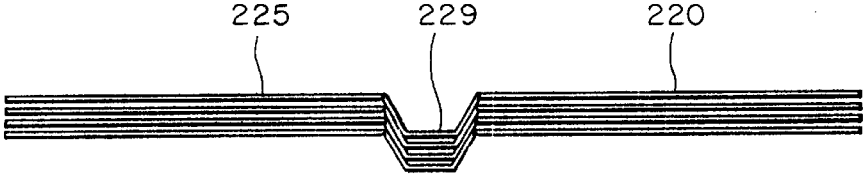
Fig. 8

FOLDABLE FENCE INSERTS

This application is a CON Ser. No. 08/423,317 filed Apr. 18, 1995.

The present invention is directed to privacy inserts for chain link fences and, more particularly, to fence inserts which are foldable and stackable.

BACKGROUND OF THE INVENTION

Chain link fences have been widely used for many years to satisfy fencing requirements. While they provide acceptable strength and durability over many years, they do not provide privacy or serve as a windbreak due to their appertured construction. Various inserts, typically referred to as "slats", have been suggested and manufactured for increasing the privacy of a chain link fence, as well as serving as a windbreak. Many early arrangements were designed to be directly connected to the wire of the fence and required clamping or bending of a metal slat onto a link of the fence.

The inventor of the present invention overcame a problem with slats migrating upwardly and downwardly due to wind or other environmental forces, which created an unfinished uneven appearance, by providing a slat retaining means which extend through a slot in the slats and is described in U.S. Pat. No. 4,512,556 to Meglino which issued on Apr. 23, 1985.

In light of the trend to make fence inserts with substantially hollow inner portions, a shipment of fence inserts commonly requires a very large container volume. Since shipping charges are a relatively high portion of the consumer costs of fence inserts, it would be desirable to provide fence inserts which could be shipped in a manner which significantly reduces the wasted air space in the shipment. Furthermore, by reducing the overall volume of a plurality of inserts, a greater volume of the inserts could be delivered quicker since they would require only a single truckload.

SUMMARY OF THE INVENTION

One aspect of the present invention is directed to privacy inserts for a chain link fence comprising at least two portions which are movably connected such that one portion is movable from a first position where it does not overlap another portion to a second position where at least two portions overlap.

According to another aspect of the present invention, foldable fence inserts are manufactured in a form wherein they are easily stackable without a significant amount of wasted air space between or within the individual inserts. The inserts of this embodiment of the present invention are readily foldable prior to insertion in a fence so that at least two portions of an insert overlap.

According to another preferred aspect of the prevent invention, adjacent foldable fence inserts comprise portions which overlap each other in order to enhance the privacy provided by a plurality of these inserts. According to a still further preferred embodiment, a support member passes through openings in a plurality of fence inserts in order to maintain the fence inserts in their desired position even when the fence inserts are subject to wind conditions.

These and other embodiments are described below with reference to the drawings.

BRIEF DESCRIPTION OF THE DRAWINGS

FIG. 5 is a partial perspective view of an alternative embodiment of the present invention.

FIG. 5*a* is a partial view of the fence insert shown in FIG. 5 in an unfolded position.

FIG. 6 is an end view of four of the fence inserts shown in FIG. 5 in a stacked configuration.

FIG. 7 is a partial perspective view of an alternative embodiment of the present invention.

FIG. 7*a* is a partial view of the fence insert shown in FIG. 7 in an unfolded position.

FIG. 8 is an end view of four of the fence inserts shown in FIG. 7 in a stacked configuration.

DETAILED DESCRIPTION

The illustrated embodiments of the present invention are designed to retain the advantages of a double walled fence insert wherein at least one portion of the fence insert at least partially overlaps another portion of the fence insert when positioned within a fence. In order to reduce the cost of storing and shipping fence inserts, the various embodiments of the present invention are advantageously stackable in a manner which significantly reduces the wasted air volume.

One embodiment of the present invention is illustrated in FIGS. 1–4 wherein a foldable fence insert comprises a forward portion 20 and a rear portion 25 which are connected by a connecting portion 29. As shown in the unfolded configuration illustrated in FIG. 4, the fence insert of this illustrated embodiment can be formed as a flat strip in order to maximize storage space during storing and shipping. Prior to insertion in a fence, at least a portion of each fence insert is then folded over another portion. In this illustrated embodiment, the insert is folded along an imaginary fold line defined by adjacent corners of cut out sections 28.

Figure 1:
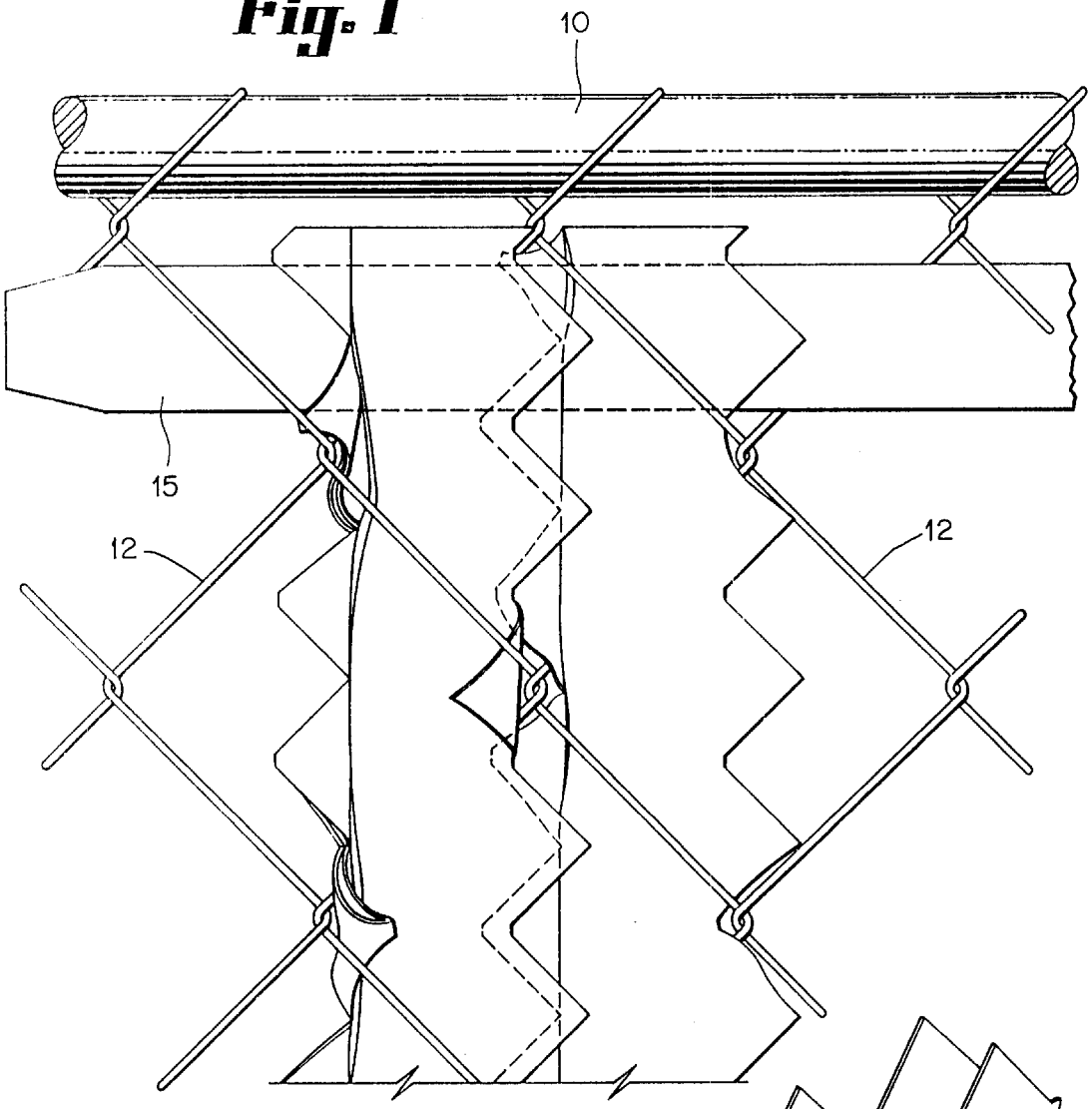
FIG. 1 is a partial perspective view of two inserts of one embodiment of the present invention positioned within a chain link fence.
Figure 2:
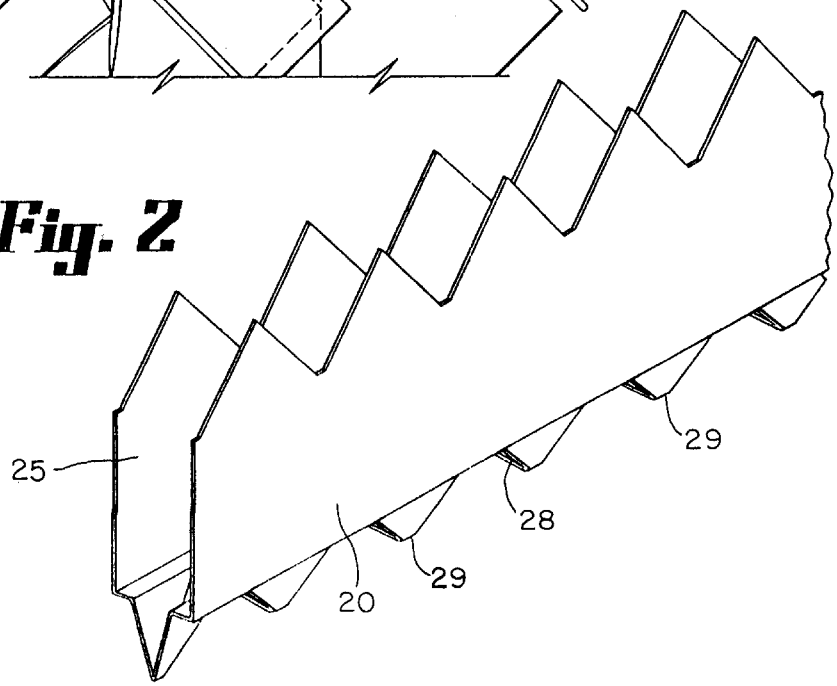
FIG. 2 is a partial, top perspective view of a fence insert shown in FIG. 1.
Figure 3:
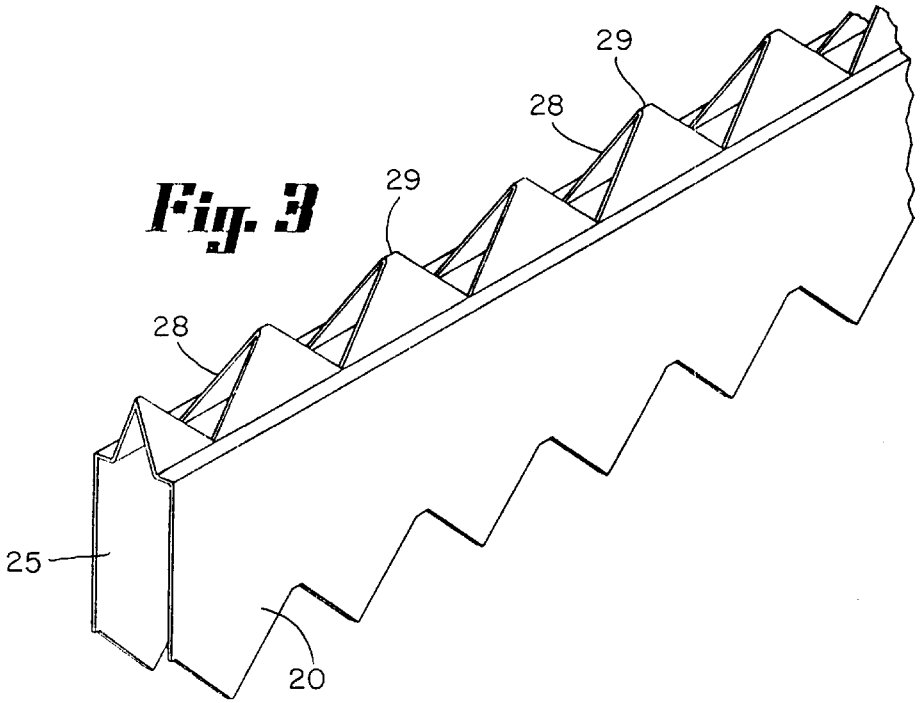
FIG. 3 is a partial, bottom perspective view of the fence insert shown in FIG. 2.
Figure 4:
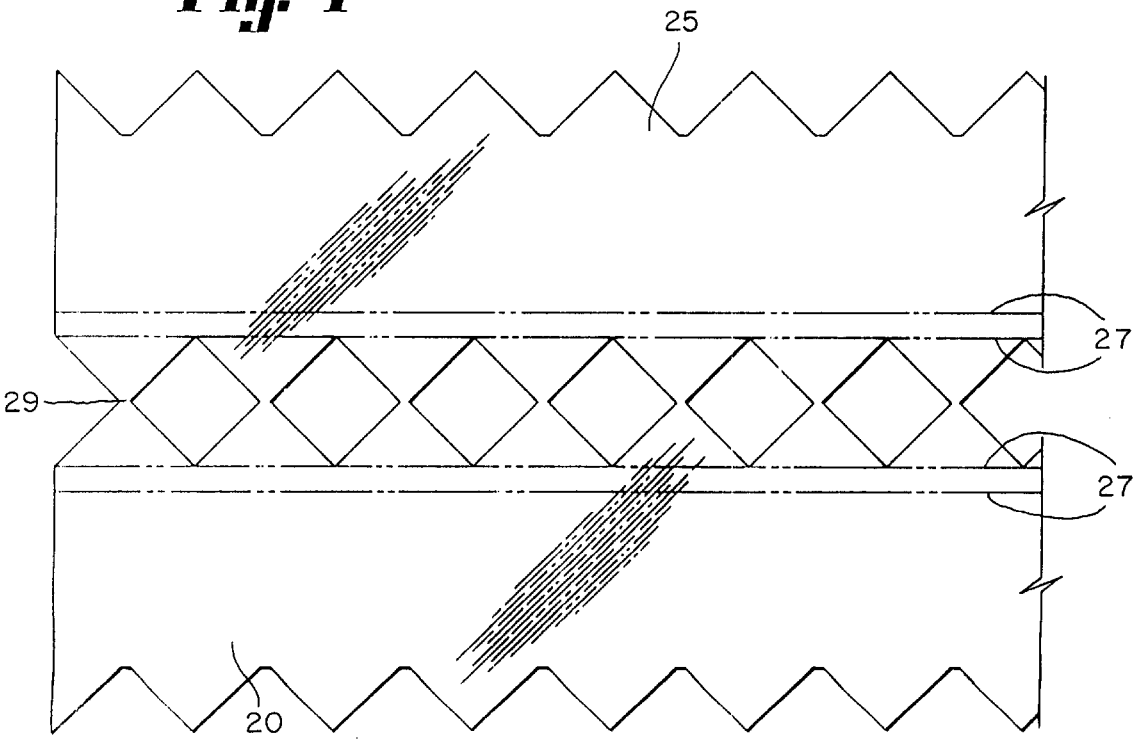
FIG. 4 is a plan view of the fence insert of FIG. 2 shown in an unfolded position.

While not necessary for obtaining the advantages of the present invention, this illustrated embodiment is also preferably folded along four other fold lines 27, which are preferably scored or otherwise weakened during the manufacturing process in order to facilitate folding prior to insertion into a fence. By folding the fence insert along fold lines 27, the width of the fence insert is advantageously increased. This enhances the overall performance of the fence insert in two ways. Primarily, the increased width of the fenced insert will tend to reduce the likelihood of noisy rattling of the fence insert within the links of the fence. Secondly, this illustrated embodiment of the present invention is designed to provide overlap of adjacent fence inserts when those inserts are inserted into a fence as shown in FIG. 1. FIG. 1 illustrates a portion of a chain link fence having an upper support bar 10 and wire links 12. In order to maximize the privacy of the fence inserts, the folded end which, in the folded configuration, includes substantially triangular projections having an apex defined by connecting portions 29 are received within the open space of an adjacent fence insert. This overlap of neighboring fence inserts is further illustrated by the vertical, zig-zag line in FIG. 1 which shows the left boundary of the fence insert on the right in FIG. 1. In order to further facilitate the retention of the fence inserts in proper position, a support bar 15 extends through openings in the fence inserts.

While the embodiment illustrated in FIGS. 1–4 comprises one version of the present invention, after seeing the present invention, those skilled in the art will also appreciate that modifications are possible without departing from the scope of the present invention. For example, while it is most preferable that the adjacent inserts of the present invention overlap, it is not necessary for practicing the present invention. Also, the shape of the inserts can be varied such that there is not total overlap between forward and rearward portions. Furthermore, the sides of the fence inserts need not be formed in an irregular non-linear shape. Still furthermore, it is not necessary that the fence inserts comprise cutout portions, however, those skilled in the art will appreciate that such cutout portions will inherently weaken the portion of the fence insert which will be folded.

An alternative embodiment of the present invention is illustrated in FIG. 5 wherein each fence insert comprises a forward face 120, rearward face 125 and curved connecting portion 129. At least one side of this fence insert is scored along portions 127 in order to facilitate folding prior to insertion in a fence. FIG. 5*a* is a partial end view of this illustrated fence insert in an unfolded configuration while FIG. 6 shows four such inserts in a stacked arrangement.

FIG. 7 illustrates a still further embodiment of the present invention wherein a connecting portion 229 comprises three generally straight segments which are connected. This embodiment which comprises a front portion 220 and rear portion 225 is similar to the embodiment illustrated in FIG. 5 with the exception of a connecting portion having a different shape.

Figure 9:
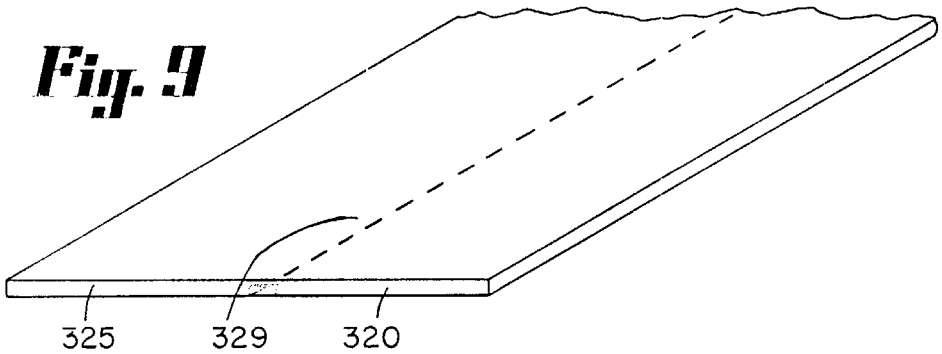
FIG. 9 is a partial perspective view of an alternative embodiment of the present invention.

A simplified embodiment of the present invention is illustrated in FIG. 9 wherein the fence insert is formed as a generally flat strip with a longitudinal scored portion 329 positioned between a forward section 320 and a rearward section 325. While the longitudinal scored portion 329 preferably extends the entire length of the fence insert, it is also possible to have a plurality of spaced scored sections which will offer the same advantages of providing a connecting portion which serves to connect at least two other portions of the fence insert and also provide sufficient resiliency so that the other portions may be folded into an at least partially overlapping configuration.

Figure 10:
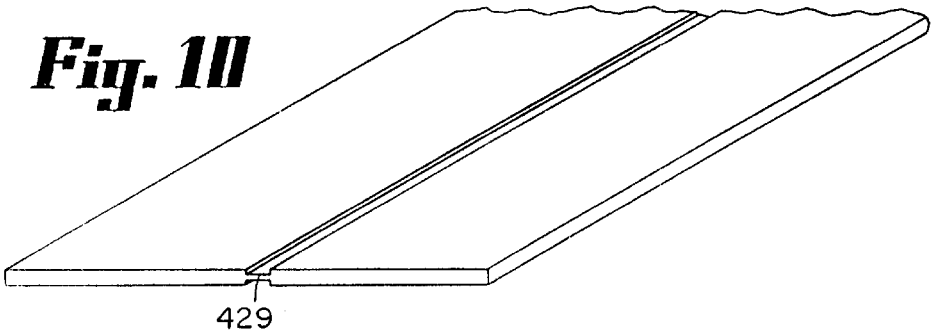
FIG. 10 is a partial perspective view of an alternative embodiment of the present invention.
Figure 11:
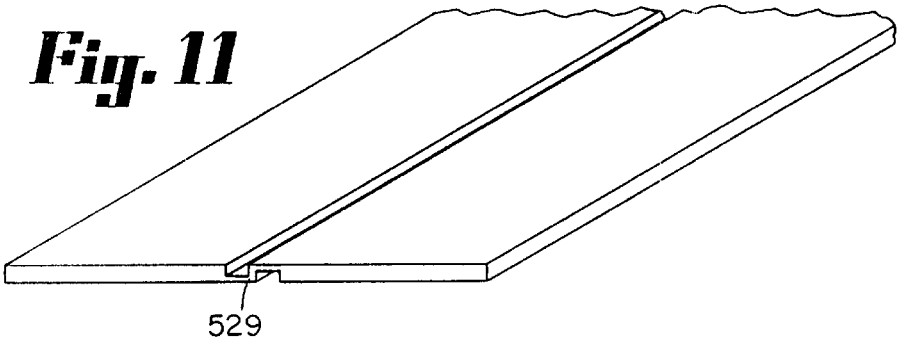
FIG. 11 is a partial perspective view of an alternative embodiment of the present invention.
Figure 12:
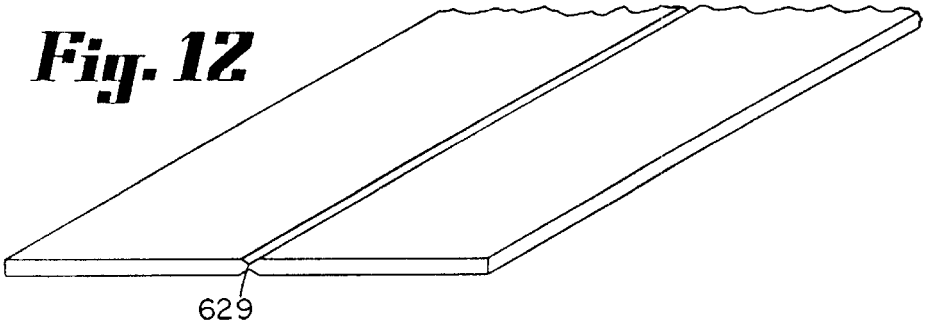
FIG. 12 is a partial perspective view of an alternative embodiment of the present invention.
Figure 13:
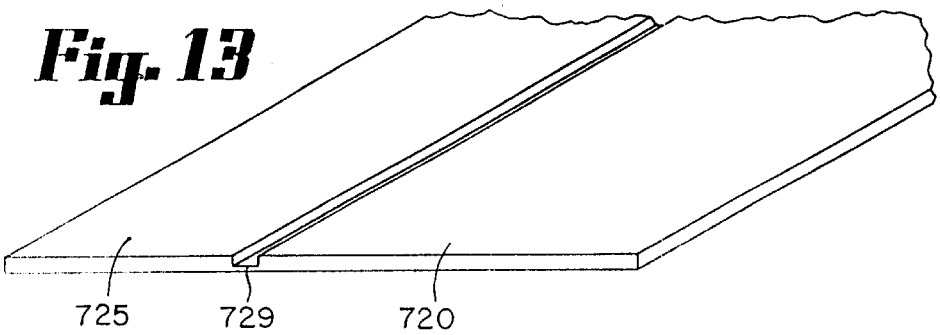
FIG. 13 is a partial perspective view of an alternative embodiment of the present invention.

Alternative embodiments of the present invention are illustrated in FIGS. 10–13. In FIG. 10, the illustrated connecting portion 429 comprises a longitudinal notch in both the upper and the lower surfaces of the fence insert, while the embodiment illustrated in FIG. 11 comprises upper and lower offset notches forming a connecting portion 529. In the embodiment shown in FIG. 12, the connecting portion 629 comprises angular notches which extend the longitudinal length of the slat. In FIG. 13, a longitudinal notch extends for the entire length of the fence slat. While it is preferable from a manufacturing standpoint and to facilitate proper folding of this illustrated fence insert that the notch extends the entire length of the fence insert, it will also be appreciated that the portion can comprise a plurality of spaced notches. As illustrated in FIG. 13, it is not necessary that the forward portion 720 and rearward portion 725 are the same size. In this illustrated embodiment, forward portion 720 is significantly larger than rear portion 725.

Another aspect of the present invention comprises a method of inserting a fence insert into a chain link fence comprising the steps providing a fence insert having at least two portions which are movably connected by a connecting portion wherein a first portion is initially positioned in a non-overlapping position relative to a second portion, secondly moving said first portion to a position where it does overlap the second portion, and subsequently inserting said fence insert into a fence.

While the various embodiments of the present invention can be formed of a wide variety of materials, those skilled in the art will appreciate that it is most preferable to use a durable, weather-resistant material, such as a polyethylene. It is also within the scope of the present invention to use more than one material in forming a privacy insert of the present invention. For example, it is within the scope of the present invention to employ a more resilient material for certain portions, such as the notched overlapping portions in order to facilitate insertion. Different materials can advantageously be co-extruded with more rigid materials.

From the present description, those skilled in the art will appreciate that the present invention provides novel fence inserts which comprise a connecting portion for movably connecting at least two portions of the fence insert. The fence insert and methods of the present invention advantageously provide a significant reduction in the volume required for storing and shipping a shipment of fence inserts.

What is claimed is:

1. A fence slat in combination with a chain link fence comprising a plurality of channels, said fence slat comprising:

a substantially elongated weather resistant material comprising means for folding a first substantially longitudinally extending portion relative to a second substantially longitudinally extending portion, said folding means positioned generally longitudinally along said material;

wherein said substantially elongated weather resistant material is adapted to fold about said folding means so that said first and second portions are positionable in generally overlapping relation and are positioned in a channel of the chain link fence.

2. A fence slat in combination with a chain link fence according to claim 1 wherein said first portion, said second portion and said folding means are integrally formed.

3. A fence slat in combination with a chain link fence according to claim 2 wherein said first portion, said second portion and said folding means are integrally formed of a polymeric material.

4. A fence slat in combination with a chain link fence according to claim 1 wherein said material comprises polyethylene.

5. A fence slat in combination with a chain link fence according to claim 1 wherein said first portion is positionable in substantially the same plane as said second portion.

6. A fence slat in combination with a chain link fence according to claim 1 wherein said folding means comprises a foldable, substantially resilient material.

7. A fence slat in combination with a chain link fence according to claim 1 wherein at least one of said first portion and said second portion comprise a non-straight edge.

8. A fence slat in combination with a chain link fence according to claim 1 wherein said folding means comprises a plurality of connecting sections.

9. A fence slat in combination with a chain link fence according to claim 1 wherein said folding means comprises a plurality of linear segments.

10. A fence slat in combination with a chain link fence according to claim 1 wherein said folding means comprises at least one curved connecting segment.

11. A fence slat in combination with a chain link fence according to claim 1 wherein said folding means comprises a reduced thickness area which has a thickness less than the thickest portion of said first portion.

12. A fence slat in combination with a chain link fence according to claim 11 wherein said folding means comprises a plurality of said reduced thickness areas.

13. A fence slat in combination with a chain link fence according to claim 11 wherein said folding means comprises at least one notch.

14. A fence slat in combination with a chain link fence according to claim 13 wherein said folding means comprises at least one tapered notch.

15. A fence slat in combination with a chain link fence according to claim 1 wherein said substantially elongated weather resistant material is foldable so that said first and second portions are positionable in generally a parallel overlapping relation.

16. A fence slat in combination with a chain link fence according to claim 1 wherein said means for folding is disposed longitudinally along the middle of said substantially elongated weather resistant material.

17. A fence slat in combination with a chain link fence according to claim 1 wherein said fence slat is configured so that when inserted into the channel of the chain link fence a portion of said slat overlaps a portion of an adjacent slat.

18. A method of inserting a fence slat into a channel of a chain link fence comprising the steps of:

providing said fence slat comprising a substantially elongated weather resistant material comprising a first substantially longitudinally extending portion, a second substantially longitudinally extending portion, and means for folding said first substantially longitudinally extending portion relative to said second substantially longitudinally extending portion, said folding means positioned generally longitudinally along said material;

folding said substantially elongated weather resistant material so that said first and second portions are positioned in generally overlapping relation; and subsequently inserting said folded fence slat into said channel of said fence, wherein said folding means, said first portion and said second portion are inserted in said channel.

19. A method according to claim 18 wherein said fence slat is configured so that when inserted into the channel of the chain link fence a portion of said slat overlaps a portion of an adjacent slat.

20. A plurality of fence slats in combination with a chain link fence comprising a plurality of channels, each of said fence slats comprising:

a substantially elongated weather resistant material comprising means for folding a first substantially longitudinally extending portion relative to a second substantially longitudinally extending portion, said folding means positioned generally longitudinally along said material;

said first and second portions are folded about said folding means and are each positioned in a channel of said chain link fence.

* * * * *